US005807212A

United States Patent [19]

Nelson

[11] Patent Number: 5,807,212

[45] Date of Patent: Sep. 15, 1998

[54] LEG EXERCISER PARTICULARLY ADAPTED FOR USE UNDER DESKS

[76] Inventor: Marvel H. Nelson, 592 Cty. Hwy. U, Mineral Point, Wis. 53565

[21] Appl. No.: 760,040

[22] Filed: Dec. 4, 1996

[51] Int. Cl.[6] ..... A63B 21/22; A63B 23/04

[52] U.S. Cl. ..... 482/60; 482/904

[58] Field of Search ..... 482/904, 142, 482/130, 138, 60, 129

[56] References Cited

U.S. PATENT DOCUMENTS

| | | | |
|---|---|---|---|
| 3,455,295 | 7/1969 | Kellog . | |
| 3,738,649 | 6/1973 | Miller | 482/130 X |
| 3,751,033 | 8/1973 | Rosenthal | 482/60 |
| 3,887,180 | 6/1975 | Berman . | |
| 4,601,464 | 7/1986 | Mousel | 482/60 |
| 4,739,984 | 4/1988 | Dranselka . | |
| 4,773,399 | 9/1988 | Richardson . | |
| 4,900,014 | 2/1990 | DeGraff . | |
| 4,911,435 | 3/1990 | Johns . | |
| 4,913,423 | 4/1990 | Farran et al. . | |
| 4,921,247 | 5/1990 | Sterling | 482/130 X |
| 4,925,184 | 5/1990 | McJunkin, Jr. et al. . | |
| 4,936,573 | 6/1990 | Miller . | |
| 5,284,131 | 2/1994 | Gray . | |
| 5,308,302 | 5/1994 | Miller . | |
| 5,312,312 | 5/1994 | Fernandez et al. . | |

FOREIGN PATENT DOCUMENTS

| | | | |
|---|---|---|---|
| 1516401 | 7/1969 | Germany | 482/904 |

OTHER PUBLICATIONS

Enrichments, Spring 1997, Bolingbrook, IL, p. 3.
AdaptAbility, Summer 1995, Colchester, CT, p. 34.
AliMed, Inc., 1996–1997, Dedham, MA, p. W183.
American Health Care Supply, 1995–1996, Northbrook, IL, pp. 7 and 180.
Flaghouse Rehab, Fall 1995, Mount Vernon, NY, p. 31.
Health Care, 1993, Bellwood, IL, p. 42.
Comfortably Yours, 1992, Chattanooga, TN, p. 29.
Harriet Carter, 1996, Northbrook, PA, pp. 47 and 85.
Enrichments, 1995–1996, Boling Brook, IL, p. 5.
U.S. News & World Report, Jan. 11, 1993, p. 62.
Time, Nov. 5, 1990, p. 57.
Hopkins Technology, Hopkins, MN.
Deskercise International, Presswire Aug. 28, 1996.
Dialog Full Text Patent (No Drawings): U.S. Patent No. 4,263,902 to Dranselka, Issued Apr. 21, 1981.
Dialog Full Text Patent (No Drawings): U.S. Patent No. 5,314,392 to Hawkins et al., Issued May 24, 1994.
Dialog Full Text Patent (No Drawings): U.S. Patent No. 5,256,118 to Chen, Issued Oct. 26, 1993.
Dialog Full Text Patent (No Drawings): U.S. Patent No. 5,080,353 to Tench, Issued Jan. 14, 1992.
Dialog Full Text Patent (No Drawings): U.S. Patent No. 4,946,162 to Lubie, Issued Jul. 7, 1990.
Dialog Full Text Patent (No Drawings): U.S. Patent No. 4,502,680 to Blum et al., Issued Mar. 5, 1984.
Dialog Full Text Patent (No Drawings): U.S. Patent No. 4,452,449 to Propst, Issued Jun. 5, 1984.
Dialog Full Text Patent (No Drawings): U.S. Patent No. 4,914,423 to Farran et al., Issued Apr. 3, 1990.

*Primary Examiner*—Richard J. Apley
*Assistant Examiner*—William LaMarca
*Attorney, Agent, or Firm*—DeWitt Ross & Stevens SC

[57] ABSTRACT

A leg exerciser including a leg exercise device sized to fit beneath the desk of a user, and an anchoring device attached to the exercise device. The anchoring device is adapted to be affixed to the user's chair. This allows the user to sit at his or her desk in the chair and actuate the leg exerciser while doing so.

12 Claims, 3 Drawing Sheets

LEG EXERCISER PARTICULARLY ADAPTED FOR USE UNDER DESKS

FIELD OF THE INVENTION

The invention relates generally to leg-actuated exercise devices, and specifically to compact leg-actuated exercise devices which may be situated beneath a desk for use as a user is working at that desk.

DESCRIPTION OF THE PRIOR ART

Owing to busy schedules, many people do not engage in the amount of exercise recommended by health authorities. This is particularly true of white-collar workers who tend to work at their desks all day. Employers have an interest in keeping these workers healthy in order to maximize productivity and to minimize costs related to the worker's health, such as insurance costs. However, relatively few employers have initiated exercise programs for their employees during work hours, mainly because such programs represent time taken away from the primary activities of the business. Also, it has been found that participatory worker exercise programs during non-working hours—e.g., free employee access to health facilities—are generally only utilized by those who are in a substantially fit condition to begin with. Thus, there is a need for an exercise device which could be used by workers during their work hours, and which does not affect (or has minimal effect on) worker productivity.

To be attractive for use in the workplace, the device should be usable by the user as he or she is sitting at a standard office desk, and it should not require motion of the user's upper body because this could interfere with common work tasks such as reading, writing, or using the telephone. Following is a description of several lower body exercise devices known to the art for allowing exercise of the user's legs while the user is in a seated or reclined position.

U.S. Pat. Nos. 4,936,573 and 5,308,302 to Miller illustrate an exercise device for the arms and legs. U.S. Pat. No. 4,936,573 illustrates the basic device, which allows the user to reciprocate handles to cause footpedals to rock up and down. The handles can be reciprocated in unison to cause the footpedals to move in unison, or they can be moved in sequence to provide alternating motion at the footpedals.

U.S. Pat. No. 4,773,399 to Richardson illustrates an arm and leg exercising device for disabled individuals. A wheelchair is placed on a platform and is locked in place by the wheelchair brake. The patient's feet are then strapped into pedals located near the foot level. The pedals are orbitally driven by a motor to provide passive exercise. Arm exercising members are included and are driven by the motor so that they oscillate as the pedals move.

U.S. Pat. No. 5,284,131 to Gray illustrates an exercise device for disabled or partially disabled people. The device includes foot pedals which are orbitally driven by a motor. An important feature of the invention is that the crank arm for the foot pedals includes a crank arm extension whereby the effective length of the crank arm may be extended or reduced so that disabled persons can start off with a smaller range of movement and work up to larger amplitudes of orbital motion. Again, since the cranks are driven by a motor, all exercise is strictly passive.

The art also illustrates a variety of other exercise equipment for use with furniture. U.S. Pat. No. 4,913,423 to Farran et al. illustrates a chair with built-in exercise equipment. U.S. Pat. No. 5,312,312 to Fernandez et al. illustrates an orbital-type leg exerciser which is adapted to mount on a vertical wall. U.S. Pat. No. 4,925,184 to McJunkin, Jr. et al. illustrates a similar device which is mountable to a bed frame. U.S. Pat. No. 4,739,984 to Dranselka similarly illustrates an exercise device which is mountable to a chair. U.S. Pat. No. 3,455,295 to Kellogg, U.S. Pat. No. 3,887,180 to Berman, and U.S. Pat. No. 4,900,014 to DeGraff also illustrate several exemplary exercise devices.

The prior art devices generally unsuitable for use in a work setting for one or more reasons. First, they tend to be rather bulky, making them unsuitable for workplaces where floor space is valuable. Second, most of the prior art exercise devices function in such a manner that it would be exceedingly difficult, if not impossible, to read, write, and/or talk on the telephone while engaged in their operation. Third, most prior art exercise devices are not well-suited for use with standard office chairs, and will not accommodate the wide variety of different types of chairs used in office settings. Apart from structural incompatibilities which would prevent use of the prior art exercise devices with office chairs, many of the prior art devices would also tend to cause the chairs to slide on the floor or tip over during exercise. Fourth, most prior art exercise devices are not well adapted for adjustment to suit the user's comfort, an important factor in the work environment. For example, most will not allow repositioning of the seat or other area whereupon the user rests so that the device can accommodate users with different leg sizes.

SUMMARY OF THE INVENTION

The present invention addresses the problems of the prior art by providing a leg exerciser as defined by the claims set out at the end of this specification. The leg exerciser can be used by workers when performing standard work tasks such as reading, writing, typing, talking on the telephone, etc. This is done by providing a leg exercise means which is compact in size to allow it to fit underneath the user's desk as the user sits at the desk, and which is coupled to an anchor means for securely anchoring the user's standard office chair to the leg exercise means. Thus, the user can sit on a standard office chair at his or her desk, perform standard work tasks with the upper body, and simultaneously exercise his or her legs.

The leg exercise means is sized to fit beneath a standard desk, and it is preferably no taller than the height of the user's chair seat. The leg exercise means includes a pair of foot pedals, and two modes of operation are contemplated. First, the pedals can be orbitally operated, both pedals being rotatable about a common orbital axis. Second, the pedals can be restrained to move along a straight-line path by affixing them to means for providing linear resistance, such as pneumatic, hydraulic, or spring cylinders, or a spring or elastomeric rod. The latter mode of operation is preferable because orbital operation is not well suited for use under a desk, where there is generally not enough space to accommodate orbital motion of the legs.

The anchor means may take a variety of forms. Two exemplary forms of anchor means will now be described.

In a first embodiment, the anchor means includes a tray whereupon the base of a chair may rest. The tray may be corrugated, that is, it may include a number of depressed valleys and raised ridges so that the portion of the chair base that contacts the tray (i.e., the chair legs) can be retained within the valleys to prevent them from slipping or tipping within the tray. A wall preferably surrounds at least a portion of the tray to help prevent the user's chair from slipping off the tray when the user is actuating the leg exercise means. Opposing portions of the wall may include notches therein wherein a barrier bar may be inserted. This barrier bar can serve to further prevent slippage or tipping of the chair base within the tray. Any edges of the tray which are not bounded by the wall are preferably inclined to define a ramp whereby a chair can be easily rolled onto and off of the tray.

In a second embodiment, the anchor means include a barrier bar which is slidably positionable in relation to the leg exercise means, the barrier bar being oriented in a direction generally perpendicular to the direction in which the barrier bar slides. This can be achieved by attaching a stem to the barrier bar, and attaching a sleeve, channel, track, or similar structure to the leg exercise means wherein or whereupon the stem may slide. The stem can bear a series of stem apertures which are alignable with a locking aperture in the sleeve. By aligning the barrier bar against the rear of the chair base (e.g., the rear chair legs) and then inserting a front chair leg or other object simultaneously within the locking aperture of the sleeve and a corresponding stem aperture, the barrier bar can be locked in place to prevent slippage or tipping of the chair base. One object that can be used to lock the barrier bar in place is a channel member including an insertion member which is sized to simultaneously fit within the locking aperture and one stem aperture. This channel member further includes receptacles which may receive chair legs therein. Thus, the rear (or intermediate) chair legs can be held in place by the barrier bar, and the front (or other intermediate) chair legs can be retained in place within the receptacles in the channel member.

The anchor means described above offers the exerciser numerous advantages. First, it prevents the user's chair from slipping backward or forward in relation to the leg exercise means, an important feature since most standard office chairs have wheeled bases and thus will not remain immobile while exercising. Second, the anchor means engages both the front and rear legs of the chair (i.e., legs closer to and further from the leg exercise means) so that the likelihood of the chair tipping during exercising is also decreased. Third, the anchor means allows the chair to be engaged at variable distances from the leg exercise means so that users of various sizes, having chairs with different heights and configurations, may use the device comfortably. Fourth, it allows use with a variety of different types of chairs having different types and numbers of wheeled or non-rolling legs, including three-, four-, and five-legged chairs (with and without struts between legs); office chairs of the type having a pedestal descending from the seat and terminating in one or more branches; and others. Fifth, it allows the user to easily roll the chair from the floor onto the anchor means without lifting the chair, removably affix the base of the chair within the anchor means, and then disengage the anchor means at a later time to allow the chair to be rolled out of the anchor means.

Further advantages, features, and objects of the invention will be apparent from the following detailed description of the invention in conjunction with the associated drawings.

DETAILED DESCRIPTION OF THE INVENTION

Figure 1:
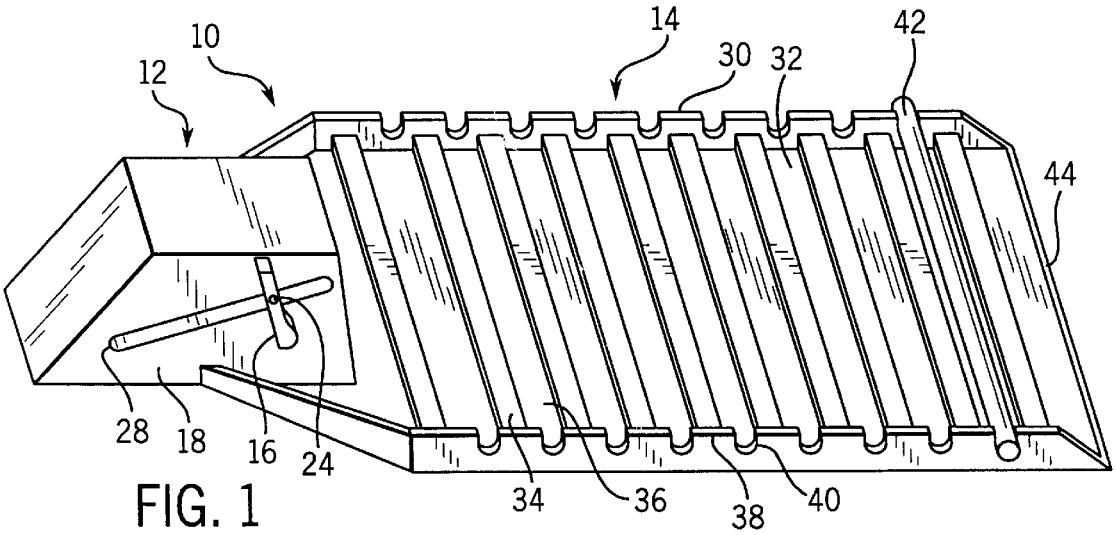
FIG. 1 is a perspective view of a first embodiment of a leg exerciser in accordance with the present invention.
Figure 2:
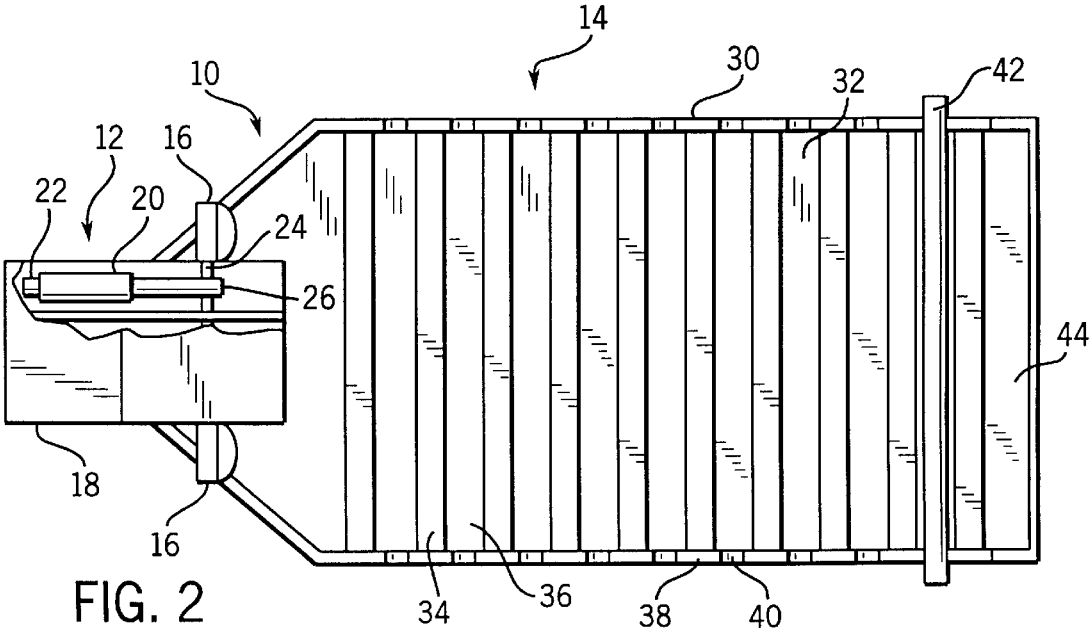
FIG. 2 is a top view of the leg exerciser of FIG. 1, shown with a portion of the leg exercise means partially cut away.

In the drawings, wherein the same or similar features are designated in all Figures with the same reference numerals, a first embodiment of the leg exerciser is illustrated in FIGS. 1 and 2 at the reference number 10. The leg exerciser 10 has two main parts: a leg exercise means 12 for exercising the legs of a user, and an anchor means 14 for anchoring the leg exercise means in fixed relation to a chair at a user-selected distance from the chair. The leg exercise means 12 and anchor means 14 will be discussed in turn below.

The Leg Exercise Means

Figure 8:
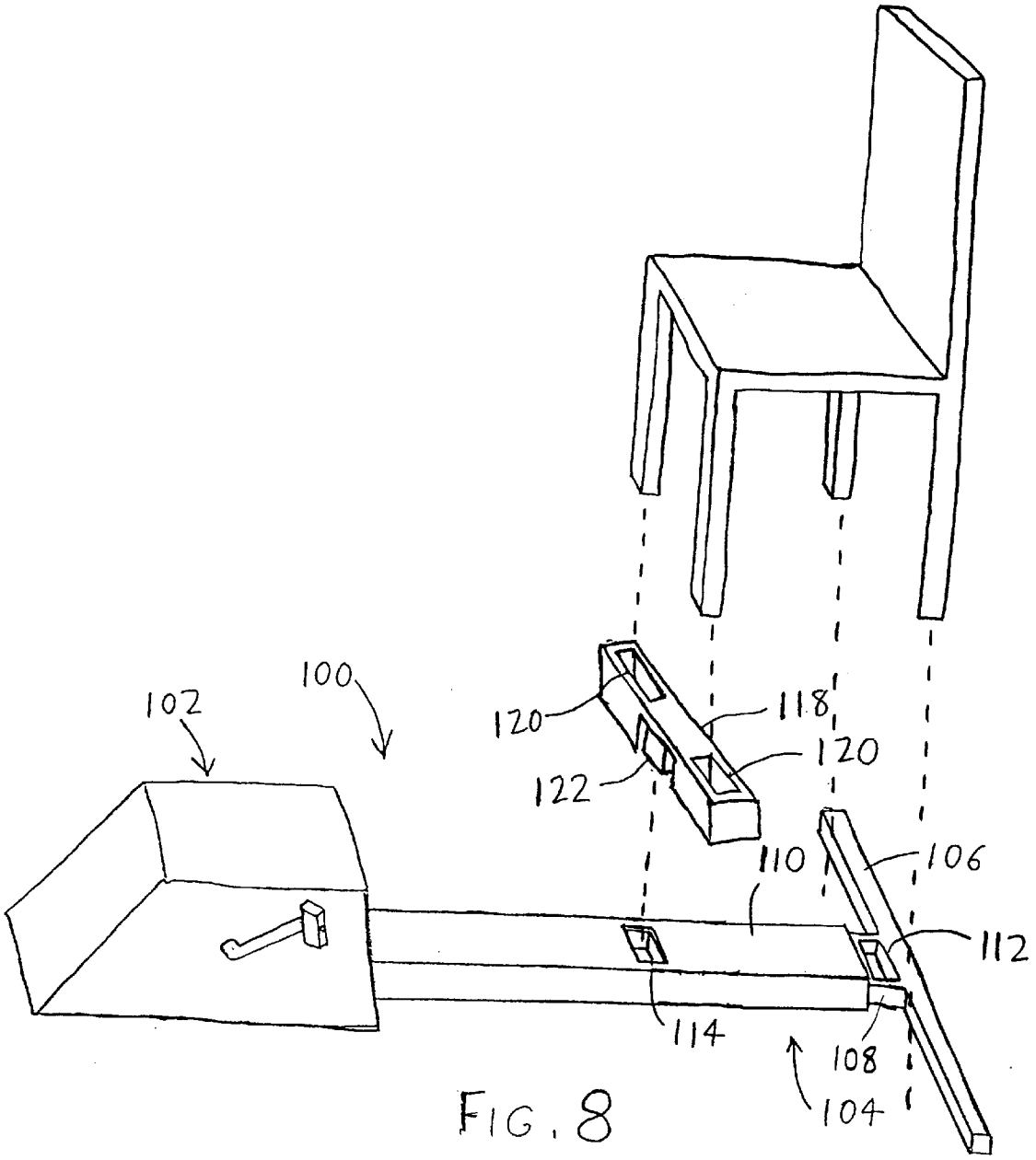
FIG. 8 is an exploded perspective view of the leg exerciser of FIG. 3 illustrated with an orbital-type actuation mechanism, and also with a chair.

The leg exercise means 12 includes two pedals 16 located on opposite sides of a housing 18. The housing 18 stores resistance means for supporting the pedals 16 and for offering resistance to the user's actuation of the pedals 16. While the resistance means can be provided in the form of an orbital-type actuation mechanism (as exemplified by the patents noted above, which are hereby incorporated by reference, as well as in the embodiment of FIG. 8), the resistance means preferably provides reciprocating motion rather than orbital motion. In other words, the pedals 16 are preferably restrained by the resistance means to move along a straight-line path, and to provide resistance when moved out of a datum or "rest" position situated along this path. As illustrated in FIG. 2, the resistance means may take the form of a pneumatic spring cylinder 20 which is pivotally or fixedly mounted to the housing 18 at a first end 22, and to a pedal bar 24 at a second end 26 of the cylinder 20. As best illustrated by FIG. 1, each pedal bar 24 is rotatably journalled within one pedal 16, and it is mounted within a slot 28 in the housing 18 so that it may slide in a linear path along the length of the housing 18 in a direction parallel to the axis of the cylinder 20. While such a feature is not fully illustrated in FIG. 2, each pedal bar 24 is supported within the interior of the housing 18 by an internal guide, for example, a wall which bears a slot parallel to slot 28, a U-channel wherein the pedal bar 24 may ride, or a similar structure for supporting the side of the pedal bar 24 within the housing 18 and guiding it along a path parallel to the slot 28.

It is preferable (though not a requirement) that each individual pedal 16 be individually supported by resistance means so that each pedal 16 can be individually actuated by the user. This allows a user to selectively exercise one leg if he or she so desires. However, a single pedal bar 24 extending between slots 28 on opposite sides of the housing 18 can be provided if it is desired that the pedals 16 be operated in tandem, that is, that actuation of one pedal 16 automatically actuates the other pedal 16.

It is understood that the pneumatic spring cylinder 20 could be replaced by other forms of resistance means for supporting the pedals 16 and resisting their movement from a rest position, for example, a pneumatic or hydraulic cylinder or dashpot, an elastomeric rod or tube, a spring, or other resistance means known to the art.

The housing 18 has a low profile so that it may fit under a desk, and it preferably has a vertical height no higher than that of the chair seat whereupon the user will sit when actuating the leg exercise means 12. This low profile for the housing 18 is such that the user's knees will not bump the bottom of the desk when the user sits and actuates the leg exercise means 12.

The Anchor Means

The anchor means 14 allow the user to fix the leg exercise means 12 at a user-selected distance from the chair, thereby (1) placing the leg exercise means 12 at a distance from the chair which is comfortable to the user, and (2) preventing the tipping or horizontal slippage of the chair when the user sits upon the chair and actuates the leg exercise means 12. As FIGS. 1 and 2 illustrate, the anchor means 14 are preferably provided in the form of a tray 30 whereupon the entirety of the base of a chair may rest. The term "base" is intended to mean those portions of the chair which contact the floor when the chair is in its normal operating position. However, as will be discussed below, it is not essential that the anchor means 14 support the entirety of the base of the chair; rather, what is most recommended is to have the anchor means engage a portion of the chair base closer to the leg exercise means 12 and also a portion of the chair further from the leg exercise means 12 (for example, both the front and rear legs of the chair). This arrangement is highly effective in preventing horizontal slippage of the chair during exercise, but more importantly, it is far more effective in preventing tipping of the chair than if the chair base was engaged a single distance from the chair (e.g., at the rear legs only) since the moment force of tipping is spread over a larger area of the chair base. To this end, the tray 30 includes a floor 32 whereupon a number of spaced ribs 34 are located, the spacing between the ribs 34 defining valleys 36. Thus, the front and/or rear legs of the chair may rest within valleys 36 between adjacent ribs 34 to restrain them from tipping and/or horizontal slippage. The valleys 36 are preferably ½ inch–1 inch (1.25 cm–2.5 cm) deep so that a chair will be highly resistant to slippage out of the valleys 36, and/or to tipping, when the chair base is situated in valleys 36 and the user is sitting in the chair.

It is possible that the spacing between the front and rear of the chair base may not precisely correspond to the spacing between valleys 36; for example, the front legs of the chair may rest within a valley 36, but the rear legs may rest atop a rib 34. As a result, the rear legs would not be restrained from motion, and this could result in tipping and/or horizontal slippage of the chair during use of the exerciser 10. To avoid this tipping/slippage, the tray 30 is preferably also provided with side walls 38 which not only prevent a chair from slipping sideways off the tray 30, but which also include notches 40 wherein a barrier bar 42 may be inserted to provide a further barrier for preventing motion of the chair base on the tray 30. The notches 40 are preferably aligned immediately adjacent the valleys 36 so that the barrier bar 42, once installed, will rest between adjacent ribs 34 to restrain the edge of a chair base located atop a rib 34.

The aforementioned arrangement is believed to offer a highly effective means for restraining the chair base from motion when the leg exercise means 12 are in use. By having the anchor means 14 grasp the chair base at two or more points which are located at different distances from the leg exercise means, the exerciser 10 more effectively prevents tipping of the chair when the user actuates the leg exercise means 12 because moment forces on the chair base are distributed over at least two points on the chair base, rather than at a single fulcrum point. The grasping of the chair base at two or more points within the anchor means is also more effective in preventing horizontal slippage of the chair than if a single point alone was grasped. Further, the anchor means 14 allow location of the chair at any distance from the leg exercise means 12 that the user desires, thereby allowing the user to more comfortably use the exerciser 10. If the wheels, legs, or other portions of a chair base do not rest precisely within valleys 36 (or if they do rest within valleys 36 and additional resistance against slippage is desired), they can be further restrained by insertion of one or more barrier bars 42 within notches 40. If the chair is a multi-legged one, e.g., a 5- or 6-legged chair, additional barrier bars 42 could be provided in notches 40 to form barriers along one or both sides of these intermediate legs as well. However, the formation of barriers for only the front and rear of the chair base is generally sufficient to prevent tipping and/or slippage of the chair when the leg exercise means 12 are in use.

The tray 30 also preferably has an inclined entry end 44 which forms a ramp for allowing a user to roll a wheeled chair onto the tray 30. Thus, unless a barrier bar 42 is present, it is a relatively easy matter for a user to roll a chair off of the entry end 44 of the tray 30 provided the user is not sitting in the chair.

Alternate Embodiments of the Exerciser

Figure 3:
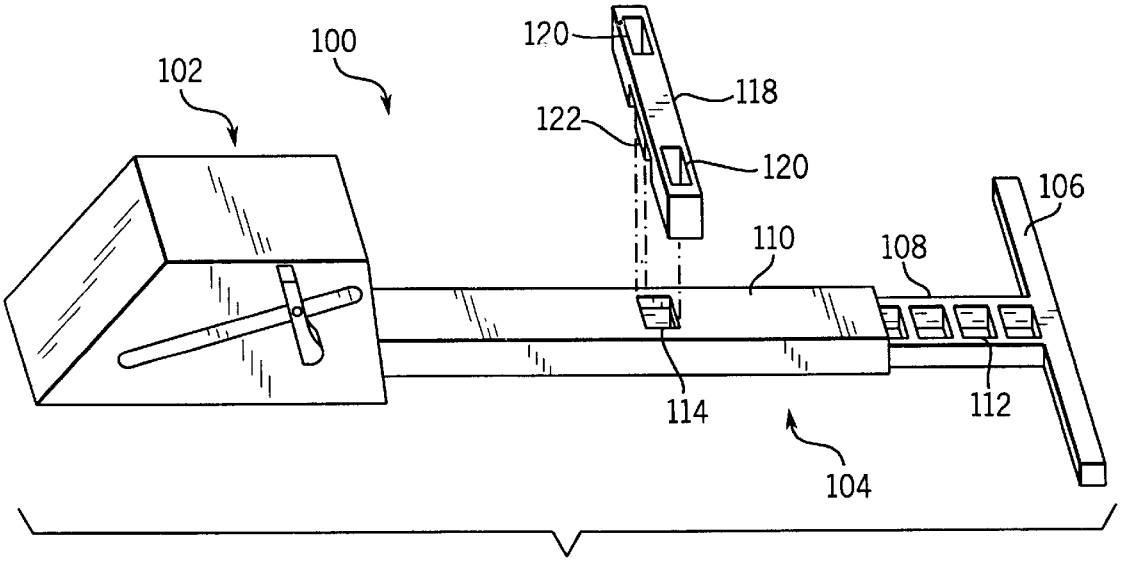
FIG. 3 is a perspective view of a second embodiment of a leg exerciser in accordance with the present invention.

FIG. 3 illustrates a second embodiment of the leg exerciser at the reference numeral 100. The leg exerciser 100 includes a leg exercise means 102 which is similar to the leg exercise means 12 described above, and it further includes an anchor means 104. This anchor means 104 is preferably in the form of a barrier bar 106 which is attached to a stem 108 slidably mounted within a sleeve 110 affixed to the leg exercise means 102. The sleeve 110 includes a locking aperture 114 and the stem 108 similarly includes a series of stem apertures 112 thereon, thereby allowing the front of a chair base (i.e., a front chair leg) to be inserted within both the locking aperture 114 and a stem aperture 112 aligned with the locking aperture 114. Once a chair leg is so inserted, the chair leg will prevent sliding of the stem 108 within the sleeve 110. Thus, to thoroughly restrain a chair within the anchor means 104, two rear or intermediate legs of the chair can be placed against the barrier bar 106 and a front leg can be placed atop the sleeve 110. The barrier bar 106 can then be pushed forward, causing the front leg of the chair to slide along the sleeve 110 until it falls within both the locking aperture 114 and a stem aperture 112. The front chair leg thereby prevents the stem 108 from sliding within the sleeve 110 and maintains the barrier bar 106 in a fixed position against the rear or intermediate legs of the chair.

Figure 4:
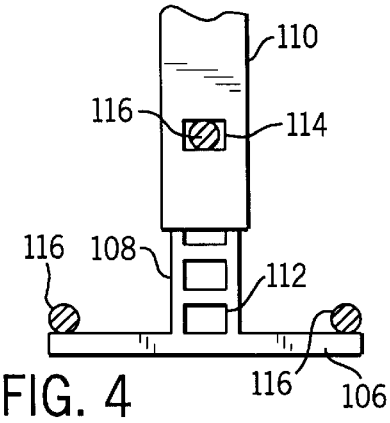
FIGS. 4–7 are top views of the anchor means of the leg exerciser of FIG. 3, shown partially cut away, illustrating various ways in which the anchor means may engage chair legs.
Figure 5:
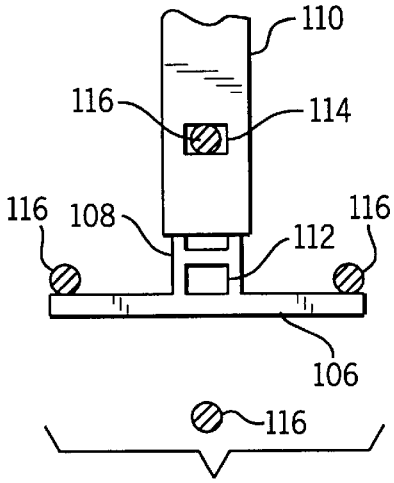
Figure 6:
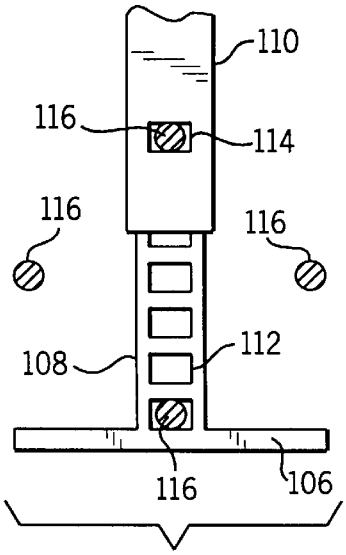

It is notable that while this embodiment of the exerciser 100 is well suited for chairs having an irregular number of legs, it is also well suited for chairs having an even number of legs and a rotatable chair seat in relation to the chair base (as is the case with common office furniture). FIG. 4 illustrates the placement of three chair legs 116 within the anchor means 104, and FIGS. 5 and 6 illustrate two exemplary placements of four chair legs 116 within the anchor means 104. While the leg placements of FIGS. 5 and 6 are not well suited for chairs wherein the seats are rigidly affixed between pairs of legs, they do accommodate chairs with seats which are rotatably affixed atop their legs, as is the common case with office chairs.

Figure 7:
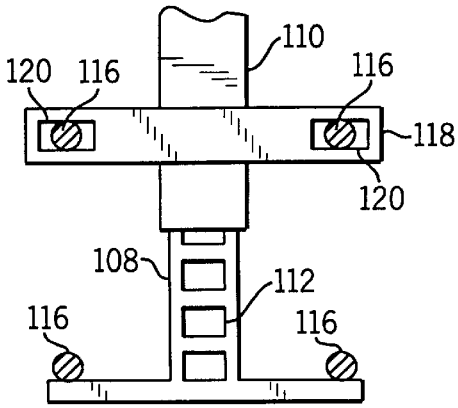

In the embodiment described above, a forward portion of the chair base is inserted within both the locking aperture 114 and a stem aperture 112 to prevent sliding of the stem 108 within the sleeve 110, thus preventing sliding of the barrier bar 106. Other forms of anchor means are contemplated wherein a separate channel member 118 is provided (as shown in FIGS. 3 and 7). The channel member 118 includes receptacles 120 sized to receive two laterally-spaced chair legs. A downwardly-extending insertion member 122 can be included between the receptacles 120, and this insertion member 122 is suitably sized to fit within both the locking aperture 114 and a stem aperture 112 to prevent sliding of the stem 108 within the sleeve 110. Use of the channel member 118 allows the placement of chair legs as illustrated in FIG. 7, wherein the receptacles 120 within the channel member 118 receive two front chair legs and the barrier bar 106 restrains two rear chair legs from horizontal motion. Use of the channel member 118 is recommended for use with chairs having seats rigidly affixed between legs, that is, wherein the chair base is not rotatable with respect to the seat.

Other forms of anchor means are contemplated as well. It is understood that the sleeve 110 need not be literally tubular in form, and may instead take the form of a channel, track, or other structure wherein or whereupon the stem may be slidably received. Similarly, the stem 108 need not take the form of the web-shaped member illustrated in FIG. 3, but may be shaped like a rod, beam, or other member, with or without apertures, notches, or other irregularities which may be engaged by objects inserted through the sleeve 110. As an example, the stem 108 may take the form of a rod having spaced apertures therein, and fasteners (e.g., thumbscrews) may be inserted through the sleeve 110 to engage the stem 108 and prevent it from sliding. As another example, the sleeve 110 may be provided with a slot along its length wherein a fastener protruding from the stem 108 may ride, and a nut on this fastener can be tightened until it engages the sleeve. Any other means known to the art for removably affixing a sliding stem within a receiving sleeve may be used. Additionally, the barrier bar 106 may itself bear receptacles similar to those in the channel member 118 so that the barrier bar 106 restricts both forward and backward slipping of chair legs, rather than only one direction of slip.

It is understood that the invention has been described above in order to illustrate the preferred embodiments of the invention. The invention is not intended to be limited to these embodiments, and is intended to encompass all alternate embodiments that fall literally or equivalently within the scope of the claims set out below. It is understood that in the claims, means plus function clauses are intended to cover the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A leg exerciser for use in combination with a chair having a chair seat supported by a chair base, the exerciser comprising:

a. a leg exercise means for exercising the legs of a user;

b. an anchor means attached to the leg exercise means for fixing the chair base at a user-selected distance from the leg exercise means, wherein the anchor means includes (1) a barrier bar slidably positionable in relation to the leg exercise means, the barrier bar being adapted to rest upon a floor surface whereupon the leg exerciser also rests, and further wherein the barrier bar is oriented in a direction generally perpendicular to the direction in which the barrier bar slides in relation to the leg exercise means;

(2) a sleeve attached to the leg exercise means, the sleeve including a locking aperture thereon;

(3) a stem slidably located within the sleeve, the barrier bar being attached to the stem, the stem including a series of stem apertures thereon, wherein each stem aperture may be selectably aligned with the locking aperture, whereby a portion of the chair base simultaneously inserted within the locking aperture and one stem aperture restrains the stem from sliding within the sleeve; and (4) a channel member including receptacles therein for receiving chair legs, the channel member also including an insertion member protruding therefrom which is sized for simultaneous insertion within the locking aperture and one stem aperture, wherein the anchor means simultaneously receives or abuts the chair base at two or more distances from the leg exercise means to thereby prevent tipping and horizontal slippage of the chair base when the user sits on the chair seat and actuates the leg exercise means.

2. The leg exerciser of claim 1 wherein the leg exercise means includes a pair of foot pedals, each pedal being rotatable about a common orbital axis.

3. The leg exerciser of claim 1 wherein the leg exercise means includes a pair of foot pedals and at least one resistance means for resisting motion of the pedals, the resistance means restraining the pedals to move along a straight-line path.

4. The leg exerciser of claim 3 wherein the resistance means consists of one of a pneumatic cylinder, a hydraulic cylinder, a spring cylinder, a spring, or an elastomeric rod.

5. The leg exerciser of claim 3 wherein the leg exercise means includes two resistance means, each resistance means restraining one pedal to move along a straight-line path.

6. A leg exerciser comprising:

a. a chair, the chair including a chair seat supported by a chair base, the chair base including at least one front leg and at least one rear leg;

b. a leg exercise means for exercising the limbs of a user sitting on the chair seat;

c. an anchor means for anchoring the leg exercise means in fixed relation to the chair seat at a user-selected distance from the chair seat, wherein the anchor means includes (1) a barrier bar slidably positionable in relation to the lea exercise means, wherein the barrier bar is adapted to rest upon a floor surface whereupon the leg exerciser also rests, and further wherein the barrier bar is oriented in a direction generally perpendicular to the direction in which the barrier bar slides in relation to the leg exercise means;

(2) a sleeve attached to the leg exercise means, the sleeve including a locking aperture thereon;

(3) a stem slidably located within the sleeve, the barrier bar being attached to the stem, the stem including a series of stem apertures thereon, wherein each stem aperture may be selectably aligned with the locking aperture, whereby a portion of the chair base simultaneously inserted within the locking aperture and one stem aperture restrains the stem from sliding within the sleeve; and (4) a channel member including receptacles therein for receiving chair legs, the channel member also including an insertion member protruding therefrom which is sized for simultaneous insertion within the locking aperture and one stem aperture, the anchor means simultaneously receiving or abutting at least one front leg and at least one rear leg.

7. The leg exerciser of claim 6 wherein the leg exercise means is vertically shorter than the chair seat.

8. The leg exerciser of claim 6 wherein the anchor means rests beneath the entirety of the chair base.

9. The leg exerciser of claim 6 wherein the leg exercise means includes a pair of foot pedals and at least one resistance means for resisting motion of the pedals, the resistance means restraining the pedals to move along a straight-line path.

10. The leg exerciser of claim 9 wherein the resistance means consists of one of a pneumatic cylinder, a hydraulic cylinder, a spring cylinder, a spring, or an elastomeric rod.

11. The leg exerciser of claim 9 wherein the leg exercise means includes two resistance means, each resistance means restraining one pedal to move along a straight-line path.

12. A leg exerciser for use in combination with a chair having a chair seat supported by a chair base, the exerciser comprising:

a. a leg exercise unit including a base and a pair of pedals situated above the base, each pedal being confined to reciprocate along a respective linear path, b. a barrier bar slidably affixed to the leg exercise unit in generally the same plane as the base of the leg exercise unit, the barrier bar being oriented generally perpendicular to the linear paths along which the pedals reciprocate, c. a channel member oriented generally perpendicular to the linear paths along which the pedals reciprocate, the channel member being anchorable at user-selectable distances from the leg exercise unit, the channel member including receptacles therein for receiving chair legs, the channel member also including an insertion member protruding therefrom which is sized for simultaneous insertion within the barrier bar and leg exercise unit, whereby the leg exerciser may rest upon a floor with the chair spaced from the leg exercise unit and with the channel member and barrier bar abutting the chair base, thereby restraining the chair from movement on the floor with respect to the leg exercise unit.

* * * * *